United States Patent [19]

Winkelmann et al.

[11] Patent Number: 4,728,013

[45] Date of Patent: Mar. 1, 1988

[54] REFRACTORY PLATE FORMED WITH EXPANSION JOINTS

[75] Inventors: Manfred Winkelmann, Krefeld; Udo Muschner, Tönisvorst, both of Fed. Rep. of Germany

[73] Assignee: Didier-Werke AG, Wiesbaden, Fed. Rep. of Germany

[21] Appl. No.: 770,775

[22] Filed: Aug. 29, 1985

[30] Foreign Application Priority Data

Sep. 5, 1984 [DE] Fed. Rep. of Germany ..... 3432613

[51] Int. Cl.[4] ..... B22D 41/10

[52] U.S. Cl. ..... 222/600; 222/598; 266/236; 266/285

[58] Field of Search ..... 222/600, 598, 599, 561, 222/591; 266/236, 271, 285; 251/367, 326; 403/28; 137/468

[56] References Cited

U.S. PATENT DOCUMENTS

| | | | |
|---|---|---|---|
| 3,616,108 | 10/1971 | Whitehouse et al. | 266/285 X |
| 3,618,925 | 11/1971 | Girolami | 222/600 X |
| 4,202,473 | 5/1980 | Szadkowski et al. | 222/598 |
| 4,314,659 | 2/1982 | Shapland | 222/598 X |
| 4,376,501 | 3/1983 | Hafner et al. | 222/600 |
| 4,529,178 | 7/1985 | Hosbein et al. | 266/285 X |

FOREIGN PATENT DOCUMENTS

| | | | |
|---|---|---|---|
| 2924467 | 1/1980 | Fed. Rep. of Germany . | |
| 2085126 | 4/1982 | United Kingdom | 222/600 |

*Primary Examiner*—H. Grant Skaggs
*Assistant Examiner*—Nils Pedersen
*Attorney, Agent, or Firm*—Wenderoth, Lind & Ponack

[57] ABSTRACT

A refractory plate assembly includes a refractory plate having therethrough at least one discharge opening and a sheath tightly fitted around the periphery of the plate. The plate is formed of separate plate portions separated along planar surfaces extending outwardly from the discharge opening at positions where cracks would be formed during use of the plate if the plate were of unitary construction. The planar surfaces are separated by compressible refractory packing material, thereby forming expansion joints. The sheath compresses the packing material of the expansion joints.

6 Claims, 9 Drawing Figures

REFRACTORY PLATE FORMED WITH EXPANSION JOINTS

BACKGROUND OF THE INVENTION

The present invention relates to a refractory plate assembly, particularly for use as a movable refractory plate in a sliding closure unit for regulating the discharge of molten metal from a metallurgical vessel.

Typically, this type of refractory plate assembly includes a refractory plate having therethrough at least one discharge opening and a metal jacket or sheath compression fitted around the peripheral surface of the refractory plate. This type of assembly however has certain inherent disadvantages. Thus, during use of the sliding closure unit the refractory plate is subjected to severe thermal stress. This results in the formation of cracks in the plate, particularly emanating outwardly from the discharge opening. The formation of such cracks inherently results in destruction of the plate.

Furthermore, the refractory plate has a planar sliding surface which abuts with a complementary sliding surface of a stationary refractory plate during use of the sliding closure unit. A portion of such planar sliding surface adjacent the discharge opening forms a closing surface area which is subjected to severe erosion by the molten metal during use. This requires that the refractory plate be replaced often or be formed entirely of a refractory material which is resistant to such erosion, and these types of resistant refractory materials conventionally are quite expensive.

Additionally known, for example from West German DE-OS No. 29 24 467, is a refractory plate assembly wherein the refractory plate is formed of plural portions separated by at least one separation joint or plane extending transversely of the discharge opening, the plural plate portions being held together by a metal jacket or sheath. Such German disclosure particularly shows a plate assembly having two discharge openings with two plate portions separated by a plane of separation passing through the two discharge openings, thus dividing the plate into two identical plate halves. This is done in order to facilitate easy replacement of hardening inserts or diaphragm inserts which are to be arranged in the discharge openings and which are formed of refractory materials which are particularly adapted to the respective casting or discharge conditions.

SUMMARY OF THE INVENTION

With the above discussion in mind, it is an object of the present invention to provide a refractory plate assembly constructed in a manner to reduce the formation in the refractory plate of cracks resulting from thermal stress during use of the assembly.

It is a further object of the present invention to provide such a refractory plate assembly incorporating the construction concept of West German DE-OS No. 29 24 467, but adapted to preclude or at least reduce the formation of cracks which characteristically are formed around the discharge opening of conventional refractory plates which are subjected to thermal stress during use.

It is a still further object of the present invention to provide such a refractory plate assembly whereby particular portions of the refractory plate may be formed of different refractory materials particularly suited to the conditions to which such portions are subjected during use.

These objects are achieved in accordance with the present invention by a construction such that the refractory plate is formed of separate plate portions separated along planar surfaces extending outwardly from the discharge opening at positions where cracks would be formed if the plate were of unitary construction. The planar surfaces are separated by compressible refractory packing material, thereby forming expansion joints. The metal jacket or sheath compresses the packing material. A refractory plate assembly of this construction, wherein expansion joints are arranged at locations which are typical for a crack or break formation, accommodates for volume changes in the plate material resulting from thermochanges or stresses. The plate assembly essentially is immune from cracks or breaks, and therefore avoids the necessity of frequent replacement. This arrangement further makes it possible to provide particular plate portions of particular refractory materials adapted to the particular conditions to which such portions will be subjected during use.

That is, the plate segments or portions formed between the expansion joints are produced of refractory materials which are most suitable for the stresses acting at such positions within the particular plate design. For example, that plate portion or segment between two expansion joints which is associated with closing and opening the discharge opening of a stationary refractory plate can be formed of a refractory material which is particularly abrasion or erosion resistant compared with other plate segments or portions. Generally speaking, the degree of erosion to which the various segments or portions of the plate assembly is subjected therefore can be made substantially comparable. This means that all of the portions of the plate assembly essentially will have the same useful life. This obviously provides substantial commercial and economic advantages. This particularly is true for refractory plate assemblies of large dimensions which also can be manufactured more easily.

In accordance with a further feature of the present invention, there are provided four expansion joints extending outwardly from the discharge opening, thereby defining four plate portions, at least two of which are of mirror-image configuration. The manufacture of the plate segments or portions thus is simplified. Even further, uniform stressing of the plate portions from the entire plate periphery is obtained, since pressure points arising from the application of stress are compensated for by slight displacements of the respective segments. The manufacture of the segments is then further simplified if the discharge opening is of rectangular configuration and the expansion joints are arranged as extensions of diagonals of the rectangular discharge opening. The segments easily are maintained in confirmation with flat and straight surfaces. Importantly, the discharge of molten material is improved with the use of a rectangular opening.

The compressible refractory packing material forming the expansion joints may be of known such materials which would be apparent to one skilled in the art, such materials obviously achieving the functions disclosed herein. Ceramic fibers or fiber mixtures are examples of materials which can be employed, but other materials again known to those skilled in the art may be employed.

BRIEF DESCRIPTION OF THE DRAWINGS

Other objects, features and advantages of the present invention will be apparent from the following detailed description, with reference to the accompanying drawings, wherein.

DETAILED DESCRIPTION OF THE INVENTION

Figure 1:
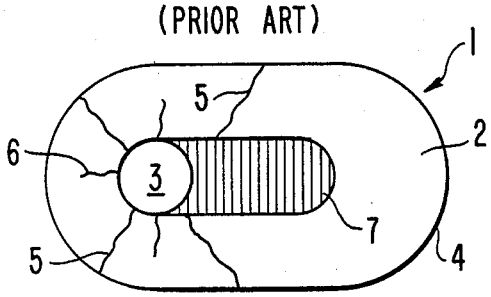
FIG. 1. (PRIOR ART)
FIG. 1 is a schematic plan view of a planar sliding surface of a known refractory plate employed in a linearly adjustable sliding closure unit, indicating the formation in the plate of cracks due to thermal stress and the formation on the sliding surface of erosion during use.

FIG. 1 illustrates a known refractory plate 1 to be employed in a linearly movable sliding closure unit. Specifically is shown a planar sliding surface 2 of plate 1 and a discharge opening 3 extending through plate 1. FIG. 1 illustrates that during use of the plate there are formed breaks or larger cracks 5 and smaller cracks 6 emanating from discharge opening 3. Breaks or large cracks 5 extend through the plate to the periphery 4 thereof. FIG. 1 also illustrates an area 7 of erosion which is formed on surface 2 during use of the plate. Thus, as plate 1 is moved linearly to control the discharge of molten metal from a metallurgical vessel, area 7 closes a discharge opening in an adjacent refractory plate, and this area 7 is subjected to extreme erosion. As this erosion continues, metal enters area 7 between the two refractory plates and solidifies therein. As a result, further linear movement of plate 1 causes still further erosion. This is a well known phenomenon in the art.

Figure 2:
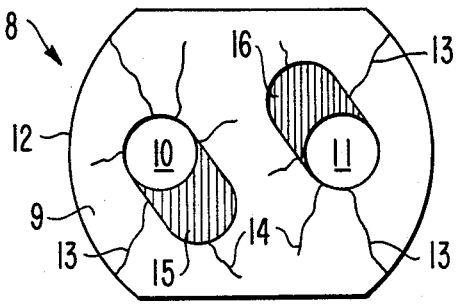
FIG. 2. (PRIOR ART)
FIG. 2 is a view similar to FIG. 1 but of a known rotary adjustable refractory plate.

FIG. 2 illustrates a rotary movable refractory plate 8 having a planar sliding surface 9 and having extending through the plate a pair of discharge openings 10, 11. FIG. 1 similarly illustrates the formation of large cracks or breaks 13 and small cracks 14 emanating from discharge openings 10, 11. Even further, FIG. 2 illustrates the formation of areas 15, 16 of erosion which form on sliding surface 9 during use.

Figure 3:
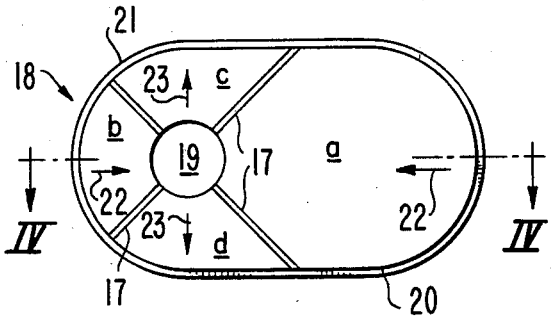
FIG. 3 is a similar view but of one embodiment of a linearly movable refractory plate assembly in accordance with the present invention.
Figure 4:
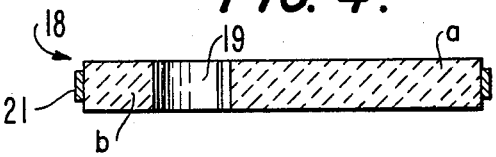
FIG. 4 is a sectional view taken along line IV—IV of FIG. 3.

It will be apparent from a consideration of FIGS. 1 and 2 that the breaks or large cracks 5, 13 emanate from the respective discharge openings in particular areas for particular refractory plate configurations. The concept of the present invention, as illustrated in FIGS. 3 and 4, involves the identification of this location of areas of crack formation. Specifically, in accordance with the embodiment of FIG. 3, the plate 18 is formed of separate plate portions a, b, c, d separated along planar surfaces extending outwardly from discharge opening 19 at those locations or positions where cracks 5 would be formed in the plate if the plate were of unitary construction in the manner shown in FIG. 1. The planar surfaces are separated by compressible refractory packing material, thereby forming expansion joints 17. A jacket or sheath, typically formed of sheet metal material, compresses the expansion joints 17 and holds the plate portions together. Thus, expansion joints 17 are filled with compressible refractory packing material, such as refractory fibers, preferably of 0.5 mm dimensions. Expansion joints 17 accommodate volume changes of the material of the plate portions occurring as a result of thermal effects during operation at those points of the plate assembly where there is danger of occurrence of large cracks or breaks. Expansion joints 17 extend entirely to the periphery 20. Specifically, four expansion joints 17 are provided, thereby defining four plate segments or portions which are held together by jacket or sheath 21, preferably shrunk on the plate periphery 20.

It will be apparent from a consideration of FIG. 3 that plate portion a will include the area 7 of erosion which occurs during use, and thus portion a may be formed of a particularly erosion resistant refractory material. As also will be apparent from a consideration of FIG. 3, shrunk on ring or sheath 21 generally works with greater stress from the periphery in the directions of arrows 22 on portions a, b. This increased force however is compensated by corresponding suitable displacement of mirror-image side segments c, d in the directions of arrows 23. As a result, the plate assembly 18 remains free of various stress forces which arise during operation and which otherwise would be harmful.

Figure 5:
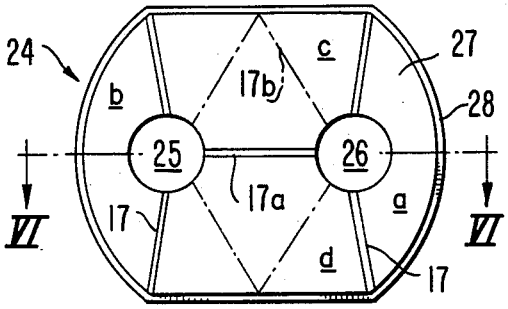
FIG. 5 is a view similar to FIG. 2 but of a rotary movable refractory plate assembly according to the present invention.
Figure 6:
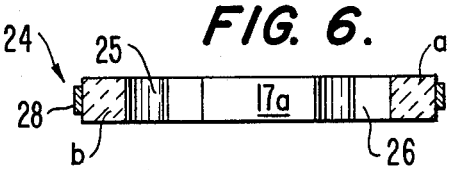
FIG. 6 is a sectional view taken along line VI—VI of FIG. 5.

Similar behavior and characteristics are exhibited in rotary movable plate 24 shown in FIGS. 5 and 6 having two discharge openings 25, 26. Thus, plate 24 is formed from four plate sections a, b, c, d separated by expansion joints 17 extending outwardly from discharge openings 25, 26 in those areas or locations where the formation of large cracks or breaks 13 are most likely, as will be apparent from a consideration of FIG. 2. Additionally, a further expansion joint 17*a* is provided between discharge openings 25, 26. Thus, the expansion joints again form four plate segments or portions held together by shrunk on ring 28. As will be apparent from a consideration of FIG. 2, plate portions c, d would be subject to greatest stress, i.e. erosion, and thus may be formed of a more erosion resistant refractory material than the material of segments a, b. FIG. 5 illustrates a further feature of this embodiment, particularly suitable for plate assemblies of large dimensions, whereby it is possible to incorporate additional expansion joints 17*b*, illustrated by dashed lines.

Figure 7:
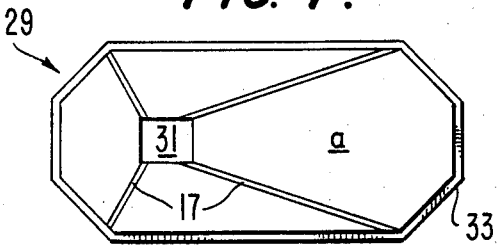
FIGS. 7–9 are views similar to FIGS. 3 and 5, but of further embodiments linearly movable refractory plate assemblies according to the present invention.
Figure 8:
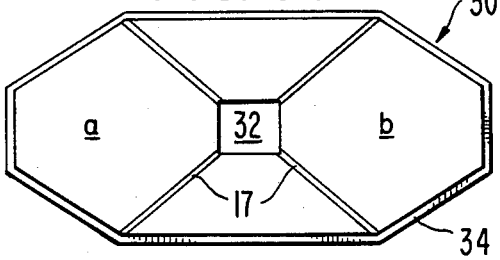

FIGS. 7 and 8 illustrate linearly movable plate assemblies 29, 30, respectively, having therein rectangular discharge openings 31, 32, respectively. Limit surfaces easily can be manufactured by finishing techniques on the segments or portions separated by expansion joints 17. One particular feature of plate 29 which provides a remarkably uniform stressing of the plate portions by the shrunk on ring 33 is the slender, wedge-like configuration of segment a, on which segment will occur erosion. Plate 30 of FIG. 8 has the discharge opening 32 thereof with a square configuration and located in the middle of the plate, with expansion joints 17 being extensions of diagonals of the square. Plate portions a, b both may be subject to erosion and are of mirror-image configuration held on by shrunk on ring 34. Plate assembly 30 can be moved linearly in either lengthwise direction. In the arrangement of FIG. 8, opposite plate portions have mirror-image configurations, and the plate additionally could be used for transverse linear movement, in addition to lengthwise displacement.

Figure 9:
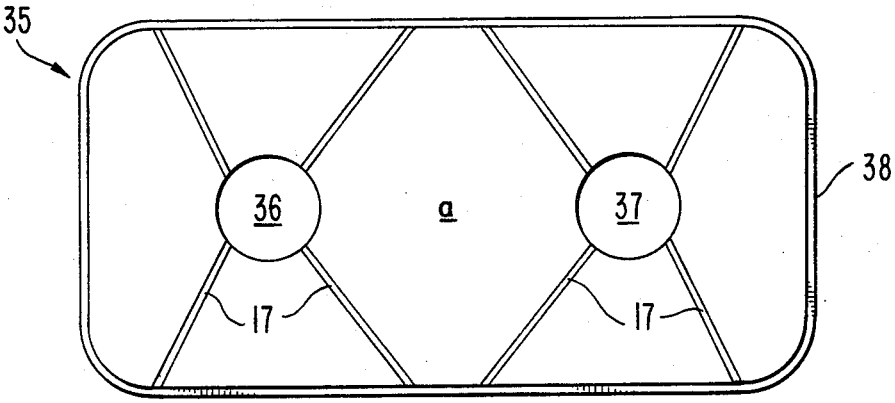

The embodiment of FIG. 9 illustrates an alternative of the embodiment of FIG. 8, wherein linearly movable plate 35 has two round discharge openings 36, 37, each of which has extending outwardly therefrom four expansion joints 17, thus dividing the plate into seven segments or portions surrounded by shrunk on ring 38. In this arrangement, the central segment or portion a adjoins both discharge openings 36, 37 and would be subjected to erosion from either discharge opening. Thus, center plate portion a could be formed of a particularly erosion resistant refractory material.

The arrangements of the expansion joints around the discharge openings shown in the illustrated embodiments allows for substantially any type and shape of plate. Even kidney-shaped or elliptical-shaped plates can be used, for example as is conventional with swivelly movable plate assemblies.

Although the present invention has been described and illustrated with respect to preferred features thereof, it is to be understood that various modifications and changes as would be apparent to those skilled in the art may be made without departing from the scope of the present invention.

We claim:

1. In a refractory plate assembly, particularly for use as a movable refractory plate in a sliding closure unit for regulating the discharge of molten metal from a metallurgical vessel, said unit being of the type including a refractory plate having therethrough at least one discharge opening and a sheath tightly fitted around the periphery of said plate, the improvement of means for reducing the formation in said plate of cracks resulting from thermal stress during use of said assembly, said means comprising:

said plate being formed of plural separate plate portions separated along respective confronting planar surfaces extending outwardly from said discharge opening, each said planar surface extending from said discharge opening to said periphery;

said planar surfaces being separated by compressible refractory packing material, thereby forming expansion joints, said refractory packing material being compressible at all operating temperatures of said refractory plate assembly;

said sheath compressing said packing material and maintaining said expansion joints sealed during expansion of said plate portions during operation of said refractory plate assembly;

and whereby said expansion joints are formed at positions where thermal stress cracks would normally occur if said plate were of unitary construction.

2. The improvement claimed in claim 1, wherein said plate has a planar sliding surface adapted to abut a complementary sliding surface of a stationary refractory plate during use of the sliding closure unit, a portion of said planar sliding surface adjacent said discharge opening forming a closing surface subject to erosion by the molten metal during use, said closing surface being positioned between two said expansion joints.

3. The improvement claimed in claim 1, comprising four said expansion joints extending outwardly from said discharge opening and defining four said plate portions, two of which are of mirror-image configuration.

4. The improvement claimed in claim 1, wherein said discharge opening is of rectangular configuration, and said expansion joints extend outwardly from corners thereof.

5. The improvement claimed in claim 4, wherein said expansion joints are arranged as extensions of diagonals of said rectangular discharge opening.

6. The improvement claimed in claim 1, wherein said packing material comprises ceramic fibers or fiber mixtures.

* * * * *